United States Patent [19]

Arnold et al.

[11] 4,229,158

[45] Oct. 21, 1980

[54] LINEAR CAPILLARY ORIFICE INJECTOR

[75] Inventors: Joe F. Arnold, North Palm Beach; Robert G. Browning, Lake Park, both of Fla.; Richard A. Meinzer, Newington, Conn.

[73] Assignee: United Technologies Corporation, Hartford, Conn.

[21] Appl. No.: 15,502

[22] Filed: Feb. 26, 1979

[51] Int. Cl.[3] ..... F23C 5/08

[52] U.S. Cl. ..... 431/178; 431/190; 331/94.5 G

[58] Field of Search ..... 431/178, 179, 190

[56] References Cited

U.S. PATENT DOCUMENTS

| | | | |
|---|---|---|---|
| 842,427 | 1/1907 | Schnelbach | 431/179 |
| 2,435,638 | 2/1948 | Shorter | 431/390 |

*Primary Examiner*—Carroll B. Dority, Jr.

*Attorney, Agent, or Firm*—Norman Friedland

[57] ABSTRACT

A linear capillary orifice injector for producing a chemical reaction in a combustion chamber is disclosed. The orifices are judiciously arranged to form a discrete pattern for achieving a high degree of shear mixing while attaining a uniform temperature and species profile particularly necessary for chemical lasers.

8 Claims, 6 Drawing Figures

LINEAR CAPILLARY ORIFICE INJECTOR

BACKGROUND OF THE INVENTION

This invention relates to injectors and particularly to gas-gas injectors utilizing linear capillary orifices.

It is well known that injectors for chemical lasers commonly utilize doublet or triplet injectors that by proper orifice orientation effectuate impingement of the two fluids for achieving mixing. These heretoknown injectors inherently produce a high turbulence of the reaction products in the combustion chamber with a consequential heat loss to the chamber walls.

We have found that we can achieve a more efficacious injector which is particularly advantageous in a chemical laser application by utilizing capillary orifices sized to provide a sonic flow. The streams of gases to be reacted are placed into parallel flow relationship at different velocities which expand as free jets until they react with each other achieving shear mixing. The orifices are arranged in linear arrays to provide uniform temperature profiles along vertical lines.

Among the advantages of this invention, although not limited thereto, are:

1. Very high injection element density along the linear array;

2. Very uniform temperature and species profile along the linear array;

3. When utilized in a two stage reaction process, the capability to place the linear arrays from the first stage as near to each other as necessary to align with the linear nozzle arrays utilized in the second stage is enhanced.

4. Optimum arrangement of the injection elements for various reactant combinations; 5. Incorporation of capillary tube injector elements into a solid face, one piece injector body so that the high velocity gas provides sufficient cooling for the injector face without supplemental cooling;

6. Sonic injection velocity at normal injector pressure drops giving absolute isolation from feed system coupling and a very high velocity ratio for improved shear mixing;

7. Good isolation from feed system coupling at subsonic injection velocities because of the high frictional pressure loss;

8. Elimination of the very small orifices (0.001" diameter for these flowrates) which would be required if conventional short orifices were used.

SUMMARY OF THE INVENTION

An object of this invention is to provide for a reactant chamber, a linear array of capillary orifices that are discretely located so as to form a pattern that provides uniform temperature and species profile. The capillary tube dimensions are selected so that the frictional pressure drop rather than the flow area regulates the flow so as to isolate the injector from the feed system coupling. Hence, pressure fluctuations from the reaction in the combustion chamber do not propogate upstream in the injector so as to adversely affect the flow and combustion stability.

Other features and advantages will be apparent from the specification and claims and from the accompanying drawings which illustrate embodiments of the invention.

DESCRIPTION OF THE PREFERRED EMBODIMENT

While this invention in its preferred embodiment is utilized for chemical lasers, it may have utility in other applications and accordingly is not limited hereto.

Figure 1:
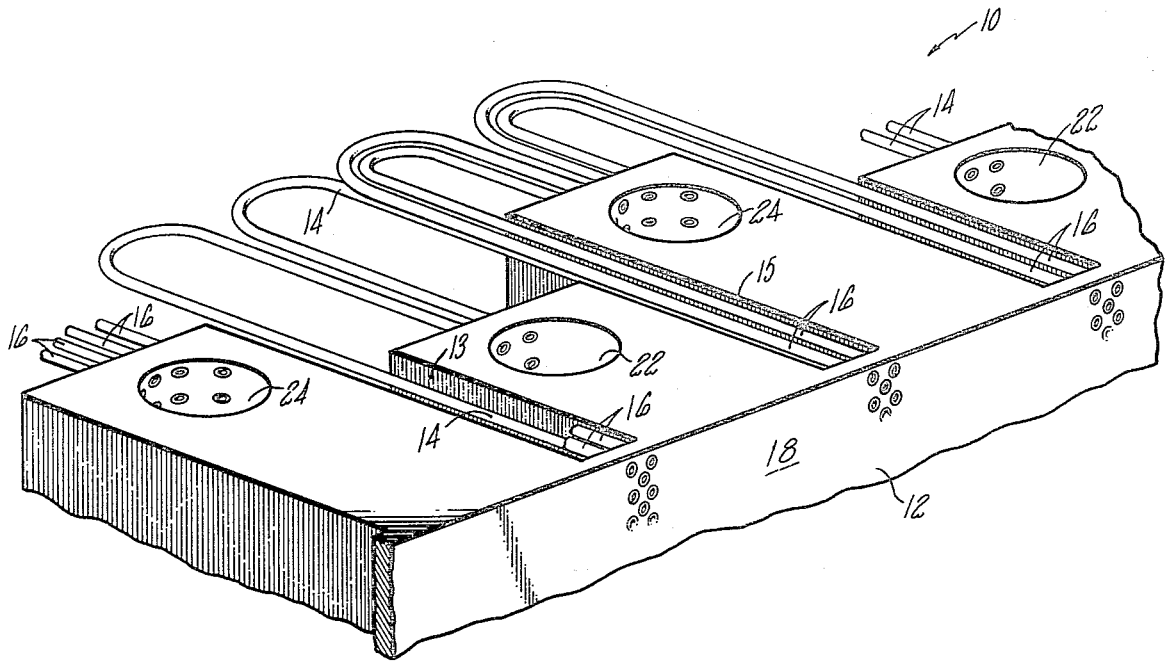
FIG.1 is a partial view in perspective illustrating the invention.

The invention can best be understood by referring to FIG. 1 which generally illustrates a partial injector reference number 1. Obviously, the injector will be sized for the particular application where it is employed. For the purposes of this invention, the invention consists of a metal block having a plurality of slots 13 and 15 to receive a plurality of capillary tubes 14 and 16 (the same numbered tubes indicate like gases). Hence in FIG. 1, the central vertically disposed stacked tubes 14 carry a first reactant (fuel) and the vertically stacked tubes 14 on either side thereof carry the second reactant (oxidizer). The face 18 of the injector forms a wall of the combustion chamber. While relatively flat in the configuration, this surface may be contoured as desired for any particular application.

The depth of block 12 is varied for weight reduction and design ease and each thickness has a vertical drilled passageway or manifold 22 and 24, respectively for receiving the first and second reactants. Hence, manifold 22 connects with a fuel source (not shown) and manifold 24 connects with an oxidizer source (not shown). The axial length of slots 13 and 15 are carefully sized so that a predetermined thickness of the front face 18 at the slot is obtained. This amount of metal in relationship to the length of tubes extending from the end of the slot to the wall 18 is selected to dissipate a given amount of heat picked up by the face of wall 18 in the combustion chamber. The heat exchange relationship is determined by the velocity of the gases flowing through the capillary tube in this area and the amount and type of metal used. Obviously, the heat transfer is selected so as to maintain the combustion face at a tolerable temperature level.

The length of capillary tube in the preferred embodiment is such that before the flow discharges into the reactant chamber, it reaches a sonic velocity. Hence, any pressure disturbance in the reactor is not evidenced upstream of the sonic flow in its capillary tube. This not only provides absolute isolation from feed system coupling but the high velocity ratio of the two adjacent gases provide improved shear mixing.

Figure 2:
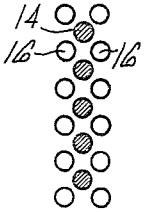
FIG. 2 is a pattern of injectors for showing the arrangement of the reactant gases of FIG. 1.
Figure 3:
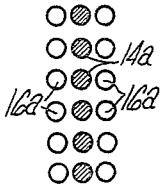
FIG. 3 is another injection pattern.
Figure 4:
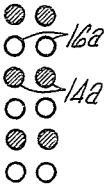
FIG. 4 is still another injection pattern.
Figure 5:
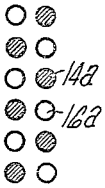
FIG. 5 is still another injection pattern.
Figure 6:
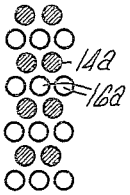
FIG. 6 is still another injection pattern.

Obviously, in the array of injectors in FIG. 1 or best seen in FIG. 2, each central fuel injector orifice shares the flow of gases with the adjacent four oxidizer injector orifices 16, except the top and bottom pair which mix completely with the two adjacent fuel orifices. Since the flow of both gases as they simultaneously leave the injector are parallel and then expand conically in free jet fashion, the flows shear and mix.

It has been found in actual testing of the device designed in accordance with FIG. 1 that the temperature profile along the vertical axis in each array is substantially constant.

Where sonic flow is not necessary, the capillary tube may be shortened but the frictional flow provides good dampening and hence is a decent isolator from fuel system coupling. Another advantage of the capillary tubes and its frictional effect is that the orifice can be larger than otherwise in a thin plate orifice. This is because the pressure drop is a direct function of length and not due only to the change in area as in the case of conventional short orifice injectors.

FIGS. 3 to 6 show other patterns of reactant combinations that have shown to be efficacious.

The optimum pattern will vary according to the molecular weights and mixture ratio of the reactants for a particular application. Note that this may also require interchanging the fuel and oxidizer positions from those indicated. Also replacing various reactant positions in a uniform pattern with one or more additional reactants would provide multi-reactant capability.

In FIGS. 3 to 6, 14*a* indicates fuel, or a first reactant, and 16*a* indicates the oxidizer, a second reactant.

It should be understood that the invention is not limited to the particular embodiments shown and described herein, but that various changes and modifications may be made without departing from the spirit and scope of this novel concept as defined by the following claims.

We claim:

1. An injector for a combustion chamber for injecting fuel and oxidizer into said combustion chamber where combustion ensues, said injector comprising a block-like element having wall means defining a face in said combustion chamber, a plurality of spaced vertically stacked capillary tubes disposed in a slot in said block-like element, which slot extends rearwardly from a point short of the face of said wall means, said capillary tubes terminating in said face and defining an array of orifices disposed in a given pattern which pattern includes two columns of parallel spaced orifices for injecting an oxidizer and a single column of orifices spaced equidistance from two adjacent parallel orifices for injecting fuel, said capillary tubes being sized so that frictional pressure drop regulates the flow therethrough, and separate fuel and oxidizer manifold means in said block-like element for communicating with an end remote from said orifices of each of said capillary tubes.

2. An injector as in claim 1 wherein said manifold are bores extending vertically in said block-like element.

3. An injector as in claim 1 wherein said capillary tubes are substantially U-shaped where the end in the manifold is in one leg of the "U" and the orifice is in the other leg of said "U".

4. An injector as in claim 1 wherein the expanse of said block-like element between the end of the slot and said face is cooled by the fuel and oxidizer flowing in said capillary tubes such that the tubes are in intimate contact with the block-like element in proximity with said expanse so that the velocity of the fuel and oxidizer cools said face at the junction of where combustion ensues.

5. An injector as in claim 1 where the array of orifices defines a pattern including three columns of vertically extending spaced orifices, three orifices being in alignment and the center of said three columns conducting fuel and the outer two columns conducting oxidizer.

6. An injector as in claim 1 where the array of orifices defines a pattern including two columns of orifices in spaced horizontal alignment and the alternate spaced orifices conduct fuel and oxidizer.

7. An injector as in claim 1 where the array of orifices defines a pattern including two columns of orifices in side-by-side relationship and one side conducts fuel and the other side conducts oxidizer.

8. An injector as in claim 1 where the array of orifices define a pattern including alternate rows of two and three orifices, the two orifices being aligned with the space between adjacent orifice in the adjacent row and alternate rows conducting fuel and oxidizer respectively.

* * * * *